US011523204B2

(12) United States Patent
Unruh et al.

(10) Patent No.: US 11,523,204 B2
(45) Date of Patent: Dec. 6, 2022

(54) EAR-MOUNTABLE LISTENING DEVICE WITH MULTIPLE TRANSDUCERS

(71) Applicant: Iyo Inc., Redwood City, CA (US)

(72) Inventors: Andrew Unruh, San Jose, CA (US); Simon Carlile, San Francisco, CA (US); Jason Rugolo, Mountain View, CA (US)

(73) Assignee: Iyo Inc., Redwood City, CA (US)

( * ) Notice: Subject to any disclaimer, the term of this patent is extended or adjusted under 35 U.S.C. 154(b) by 0 days.

(21) Appl. No.: 17/206,557

(22) Filed: Mar. 19, 2021

(65) Prior Publication Data

US 2022/0303657 A1 Sep. 22, 2022

(51) Int. Cl.
*H04R 1/10* (2006.01)

(52) U.S. Cl.
CPC ..... *H04R 1/1016* (2013.01); *H04R 1/105* (2013.01)

(58) Field of Classification Search
CPC ..... H04R 1/1016; H04R 9/063; H04R 11/02; H04R 1/1075; H04R 1/1008; H04R 1/26; H04R 5/033; H04R 2205/022; H04R 1/105
See application file for complete search history.

(56) References Cited

U.S. PATENT DOCUMENTS

| | | | | |
|---|---|---|---|---|
| 7,822,218 | B2 | 10/2010 | Van Halteren | |
| 8,488,831 | B2 | 7/2013 | Saggio et al. | |
| 8,515,103 | B2 | 8/2013 | Mei et al. | |
| 9,055,366 | B2 | 6/2015 | Azmi et al. | |
| 10,397,685 | B2 | 8/2019 | Ogata et al. | |
| 2008/0159554 | A1* | 7/2008 | Sung | G10K 11/17861 381/71.6 |
| 2009/0220113 | A1 | 9/2009 | Tiscareno | |
| 2009/0279729 | A1 | 11/2009 | Huang | |
| 2010/0105447 | A1* | 4/2010 | Sibbald | G10K 11/17857 381/71.6 |
| 2013/0058508 | A1* | 3/2013 | Oosato | H04R 1/1075 381/162 |

(Continued)

FOREIGN PATENT DOCUMENTS

| | | | |
|---|---|---|---|
| KR | 10-2018-0095542 | A | 8/2018 |
| WO | 2016/116732 | A1 | 7/2016 |

OTHER PUBLICATIONS

International Search Report and Written Opinion, PCT App. No. PCT/US2022/020073, dated Jun. 27, 2022, 8 pages.

*Primary Examiner* — Alexander Krzystan
*Assistant Examiner* — Julie X Dang
(74) *Attorney, Agent, or Firm* — Nicholson De Vos Webster & Elliott LLP

(57) ABSTRACT

An ear-mountable listening device includes a plurality of electroacoustic transducers, a manifold, and an output port. The plurality of electroacoustic transducers emit audio in response to an audio signal. The plurality of electroacoustic transducers includes a first transducer and a second transducer. The manifold is coupled to the plurality of electroacoustic transducers. The manifold is shaped to position the first transducer and the second transducer to face one another and form a front cavity disposed between the first transducer and the second transducer. The output port is coupled to the manifold to direct the audio from the front cavity into an ear when the plurality of electroacoustic transducers emits the audio.

19 Claims, 9 Drawing Sheets

(56) References Cited

U.S. PATENT DOCUMENTS

| | | | | |
|---|---|---|---|---|
| 2014/0140565 | A1* | 5/2014 | Liu | H04R 1/1091<br>381/380 |
| 2014/0169583 | A1 | 6/2014 | Huang et al. | |
| 2017/0245044 | A1* | 8/2017 | Cartwright | H04R 1/2811 |
| 2018/0146279 | A1* | 5/2018 | Wang | H04R 1/1058 |
| 2019/0020946 | A1* | 1/2019 | Tu | H04R 1/1075 |
| 2020/0275197 | A1* | 8/2020 | I | H04R 1/10 |

* cited by examiner

410-C

EAR-MOUNTABLE LISTENING DEVICE WITH MULTIPLE TRANSDUCERS

TECHNICAL FIELD

This disclosure relates generally to the field of acoustic devices, and in particular but not exclusively, relates to ear-mountable listening devices.

BACKGROUND INFORMATION

Ear mounted listening devices include headphones, which are a pair of loudspeakers worn on or around a user's ears. Circumaural headphones use a band on the top of the user's head to hold the speakers in place over or in the user's ears. Another type of ear mounted listening device is known as earbuds or earpieces and include individual monolithic units that plug into the user's ear canal.

Both headphones and ear buds are becoming more common with increased use of personal electronic devices. For example, people use headphones to connect to their phones to play music, listen to podcasts, place/receive phone calls, or otherwise. However, headphone devices are currently not designed for all-day wearing since their presence blocks outside noises from entering the ear canal without accommodations to hear the external world when the user so desires. Thus, the user is required to remove the devices to hear conversations, safely cross streets, etc.

Hearing aids for people who experience hearing loss are another example of an ear mountable listening device. These devices are commonly used to amplify environmental sounds. While these devices are typically worn all day, they often fail to accurately reproduce environmental cues, thus making it difficult for wearers to localize reproduced sounds. As such, hearing aids also have certain drawbacks when worn all day in a variety of environments. Furthermore, conventional hearing aid designs are fixed devices intended to amplify whatever sounds emanate from directly in front of the user. However, an auditory scene surrounding the user may be more complex and the user's listening desires may not be as simple as merely amplifying sounds emanating directly in front of the user.

With any of the above ear mountable listening devices, monolithic implementations are common. These monolithic designs are not easily custom tailored to the end user, and if damaged, require the entire device to be replaced at greater expense. Accordingly, a dynamic and multiuse ear mountable listening device capable of providing all day comfort in a variety of auditory scenes is desirable.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

DETAILED DESCRIPTION

Embodiments of a system, apparatus, and method of operation for an ear-mountable listening device with multiple transducers are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Described herein are embodiments of a binaural listening system and/or ear-mountable listening device including multiple transducers. Specifically, the multiple transducers provide improved low frequency capabilities while also increasing efficiency, power handling, and reducing parasitic vibrations. For example, the low frequency capability of a dynamic speaker is ultimately limited by the amount of air it can move. In-ear listening devices, with their diminutive size, represent a special challenge when it comes to recreating high impact bass or for cancelling very low frequencies as a component of an active noise cancellation (ANC)

system. Embodiments of the disclosure utilize at least two electroacoustic transducers to move at least twice as much air as a conventional in-ear monitor without substantially increasing the size of the device. In one embodiment, this is accomplished by utilizing two electroacoustic transducers, rotated by ninety degrees with respect to an output port, that face one another. The two electroacoustic transducers are held in place by a manifold that is shaped to acoustically isolate front sound waves from back sound waves such that said sound waves do not cancel out one another. Advantageously, by arranging the two electroacoustic transducers to face one another, parasitic vibrations that may be generated by an individual one of the transducers may be canceled out or otherwise mitigated by the adjacently facing transducer. Additionally, by increasing the number of transducers the amount of air moved by the listening device increases, resulting in improved low frequency capabilities that benefit, among other things, bass response and low frequency noise cancellation.

Figure 1A:
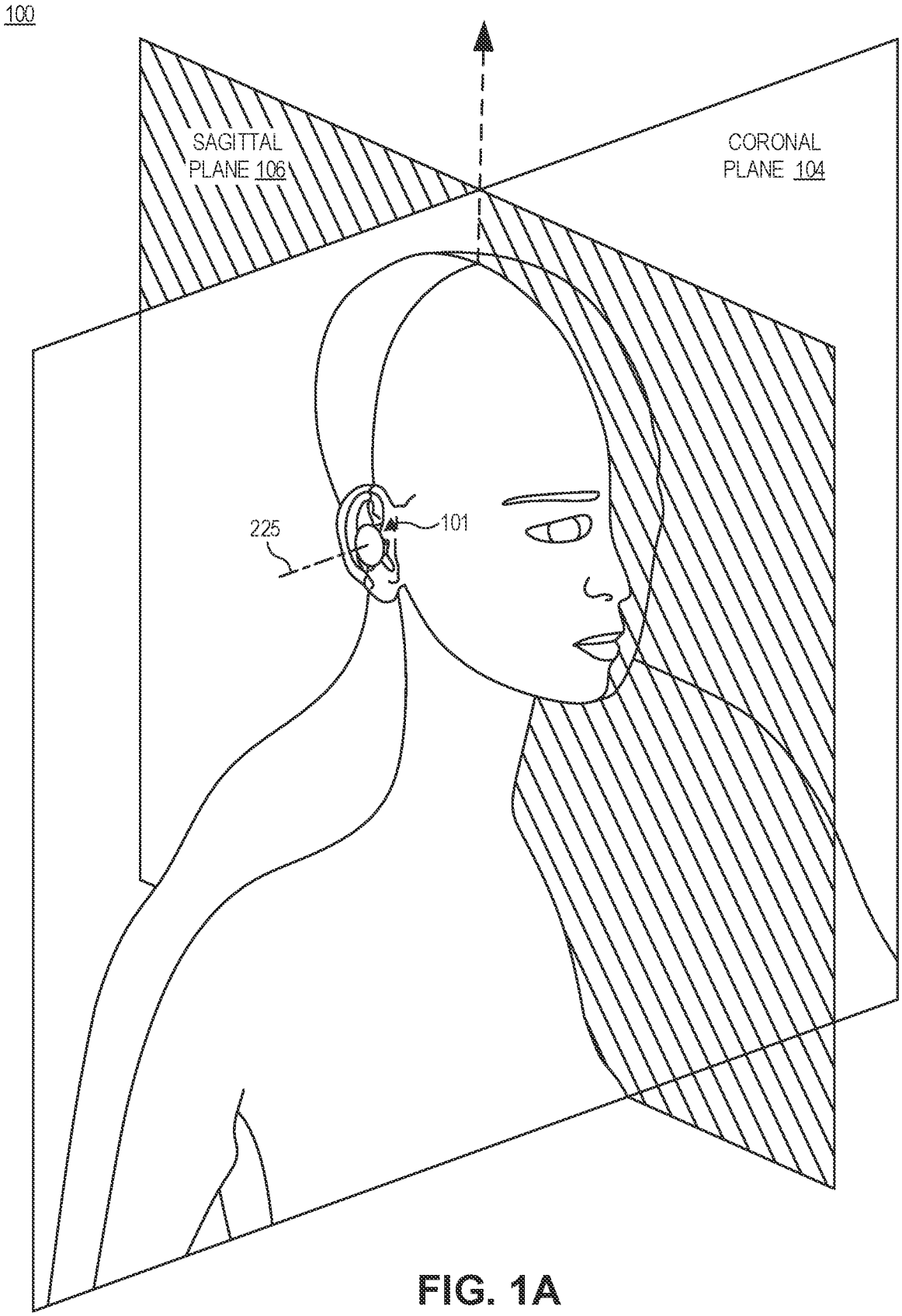
FIG. 1A illustrates a binaural listening system including an ear-mountable listening device when worn plugged into an ear canal, in accordance with an embodiment of the disclosure.
Figure 1B:
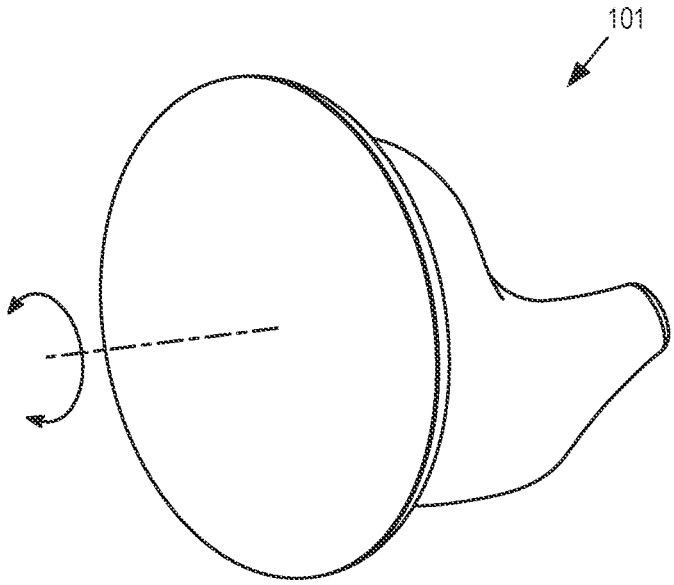
FIG. 1B is a front perspective illustration of the ear-mountable listening device, in accordance with an embodiment of the disclosure.
Figure 1C:
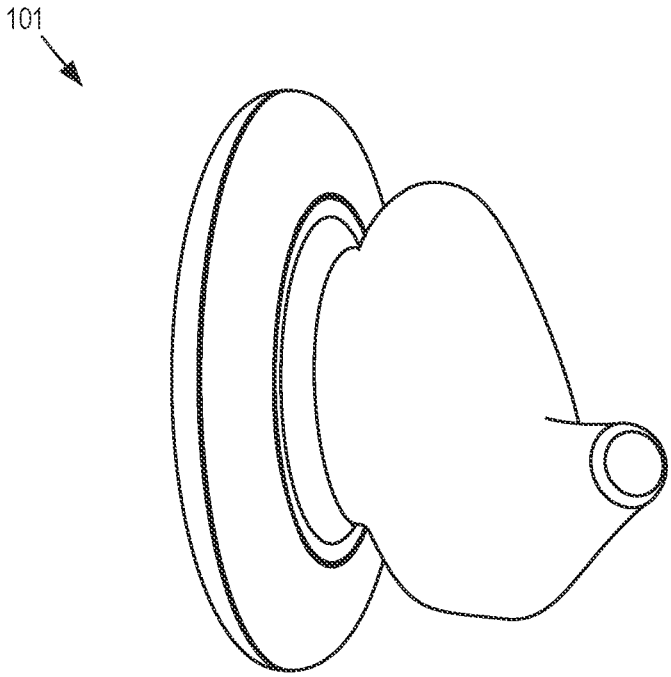
FIG. 1C is a rear perspective illustration of the ear-mountable listening device, in accordance with an embodiment of the disclosure.

FIGS. 1A-1C illustrates a binaural listening system 100 including an ear-mountable listening device 101 shown when worn plugged into an ear canal, in accordance with an embodiment of the disclosure. The ear-mountable listening device 101 may be wirelessly coupled or otherwise paired with another instance of the ear-mountable listening device (not illustrated) to form the binaural listening system 100. In various embodiments, the ear-mountable listening device 101 (also referred to herein as an "ear device") is capable of facilitating a variety auditory functions including wirelessly connecting to (and/or switching between) a number of audio sources (e.g., Bluetooth connections to personal computing devices, etc.) to provide in-ear audio to the user, controlling the volume of the real world (e.g., modulated noise cancellation and transparency), providing speech hearing enhancements, localizing environmental sounds for spatially selective cancellation and/or amplification, and even rendering auditory virtual objects (e.g., auditory assistant or other data sources as speech or auditory icons). Ear-mountable listening device 105 is amenable to all day wearing. When the user desires to block out external environmental sounds, the mechanical design and form factor along with active noise cancellation can provide substantial external noise dampening (e.g., 40 to 50 dB). When the user desires a natural auditory interaction with their environment, ear-mountable listening device 101 can provide near (or perfect) perceptual transparency by reassertion of the user's natural Head Related Transfer Function (HRTF), thus maintaining spaciousness of sound and the ability to localize sound origination in the environment.

Figure 2:
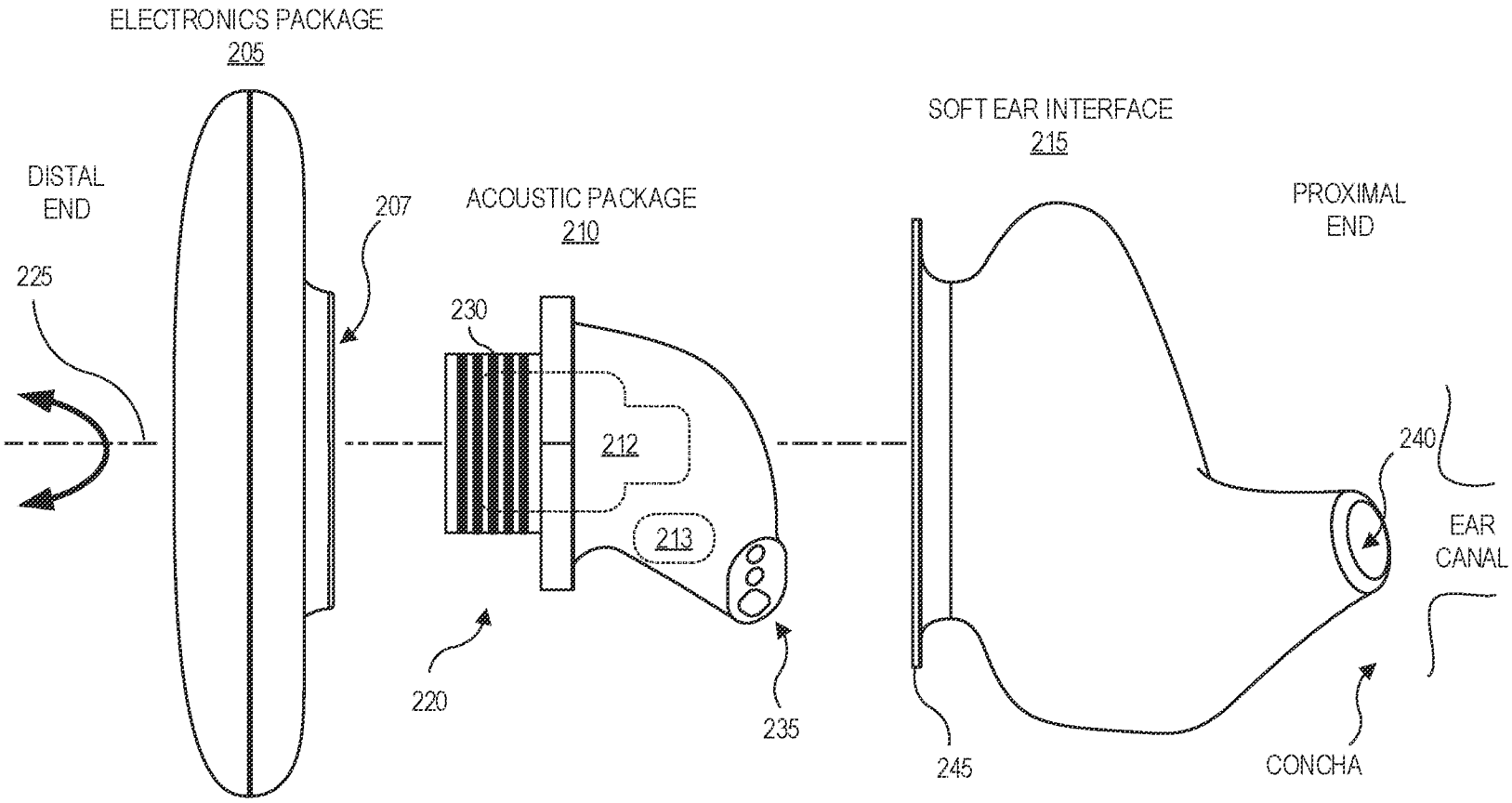
FIG. 2 is an exploded view illustration of the ear-mountable listening device, in accordance with an embodiment of the disclosure.

FIG. 2 illustrates an exploded view of ear-mountable listening device 201, in accordance with an embodiment of the disclosure. Ear-mountable listening device 201 is one possible implementation of ear-mountable listening device 101 illustrated in FIGS. 1A-1C. Referring back to FIG. 2, ear-mountable listening device 201 has a modular design including an electronics package 205, an acoustic package 210, and a soft ear interface 215. The three components are separable by the end-user allowing for any one of the components to be individually replaced should it be lost or damaged. The illustrated embodiment of electronics package 205 has a puck-like shape and includes an array of microphones for capturing external environmental sounds along with electronics disposed on a main circuit board for data processing, signal manipulation, communications, user interfaces, and sensing. In some embodiments, the main circuit board has an annular disk shape with a central hole to provide a compact, thin, or close-into-the-ear form factor.

The illustrated embodiment of acoustic package 210 includes multiple transducers or speakers 212, and in some embodiments, an internal microphone 213 for capturing user noises incident via the ear canal, along with electromechanical components of a rotary user interface. A distal end of acoustic package 210 may include a cylindrical post 220 that slides into and couples with a cylindrical port 207 on the proximal side of electronics package 205. In embodiments where the main circuit board within electronics package 205 is an annular disk, cylindrical port 207 aligns with the central hole. The annular shape of the main circuit board and cylindrical port 207 facilitate a compact stacking of speakers 212 with the microphone array within electronics package 205 directly in front of the opening to the ear canal enabling a more direct orientation of speakers 212 to the axis of the auditory canal. Internal microphone 213 may be disposed within acoustic package 210 and electrically coupled to the electronics within electronics package 205 for audio processing (illustrated), or disposed within electronics package 205 with a sound pipe plumbed through cylindrical post 220 and extending to one of the ports 235 (not illustrated). Internal microphone 213 may be shielded and oriented to focus on user sounds originating via the ear canal. Additionally, internal microphone 213 may also be part of an audio feedback control loop for driving cancellation of the ear occlusion effect.

Post 220 may be held mechanically and/or magnetically in place while allowing electronics package 205 to be rotated about central axial axis 225 relative to acoustic package 210 and soft ear interface 215. This rotation of electronics package 205 relative to acoustic package 210 implements a rotary user interface. The mechanical/magnetic connection facilitates rotational detents (e.g., 8, 16, 32) that provide a force feedback as the user rotates electronic package 205 with their fingers. Electrical trace rings 230 disposed circumferentially around post 220 provide electrical contacts for power and data signals communicated between electronics package 205 and acoustic package 210. In other embodiments, post 220 may be eliminated in favor of using flat circular disks to interface between electronics package 205 and acoustic package 210.

Soft ear interface 215 is fabricated of a flexible material (e.g., silicon, flexible polymers, etc.) and has a shape to insert into a concha and ear canal of the user to mechanically hold ear-mountable listening device 101 in place (e.g., via friction or elastic force fit). Soft ear interface 215 may be a custom molded piece (or fabricated in a limited number of sizes) to accommodate different concha and ear canal sizes/shapes. Soft ear interface 215 provides a comfort fit while mechanically sealing the ear to dampen or attenuate direct propagation of external sounds into the ear canal. Soft ear interface 215 includes an internal cavity shaped to receive a proximal end of acoustic package 210 and securely holds acoustic package 210 therein, aligning ports 235 with in-ear aperture 240. A flexible flange 245 seals soft ear interface 215 to the backside of electronics package 205 encasing acoustic package 210 and keeping moisture away from acoustic package 210. Though not illustrated, in some embodiments, the distal end of acoustic package 210 may include a barbed ridge encircling ports 235 that friction fit or "click" into a mating indent feature within soft ear interface 215.

Referring back to FIG. 1A, which illustrates how ear-mountable listening device 101 is held by, mounted to, or otherwise disposed in the user's ear, the soft ear interface 215 is shaped to hold ear-mountable listening device 101 with central axial axis 225 substantially falling within (e.g., within 20 degrees) a coronal plane 104. As is discussed in greater detail below, an array of microphones extends around the central axial axis 225 in a ring pattern that substantially falls within a sagittal plane 106 of the user. When ear-mountable listening device 101 is worn, electronics package 205 is held close to the pinna of the ear and aligned along, close to, or within the pinna plane. Holding electronics package 205 close into the pinna not only provides a desirable industrial design (relative to further out protrusions), but may also have less impact on the user's HRTF or more readily lend itself to a definable/characterizable impact on the user's HRTF, for which offsetting calibration may be achieved. As mentioned, the central hole in the main circuit board along with cylindrical port 207 facilitate this close in mounting of electronics package 205 despite mounting speakers 212 directly in front of the ear canal in between electronics package 205 and the ear canal along central axial axis 225.

Figure 3:
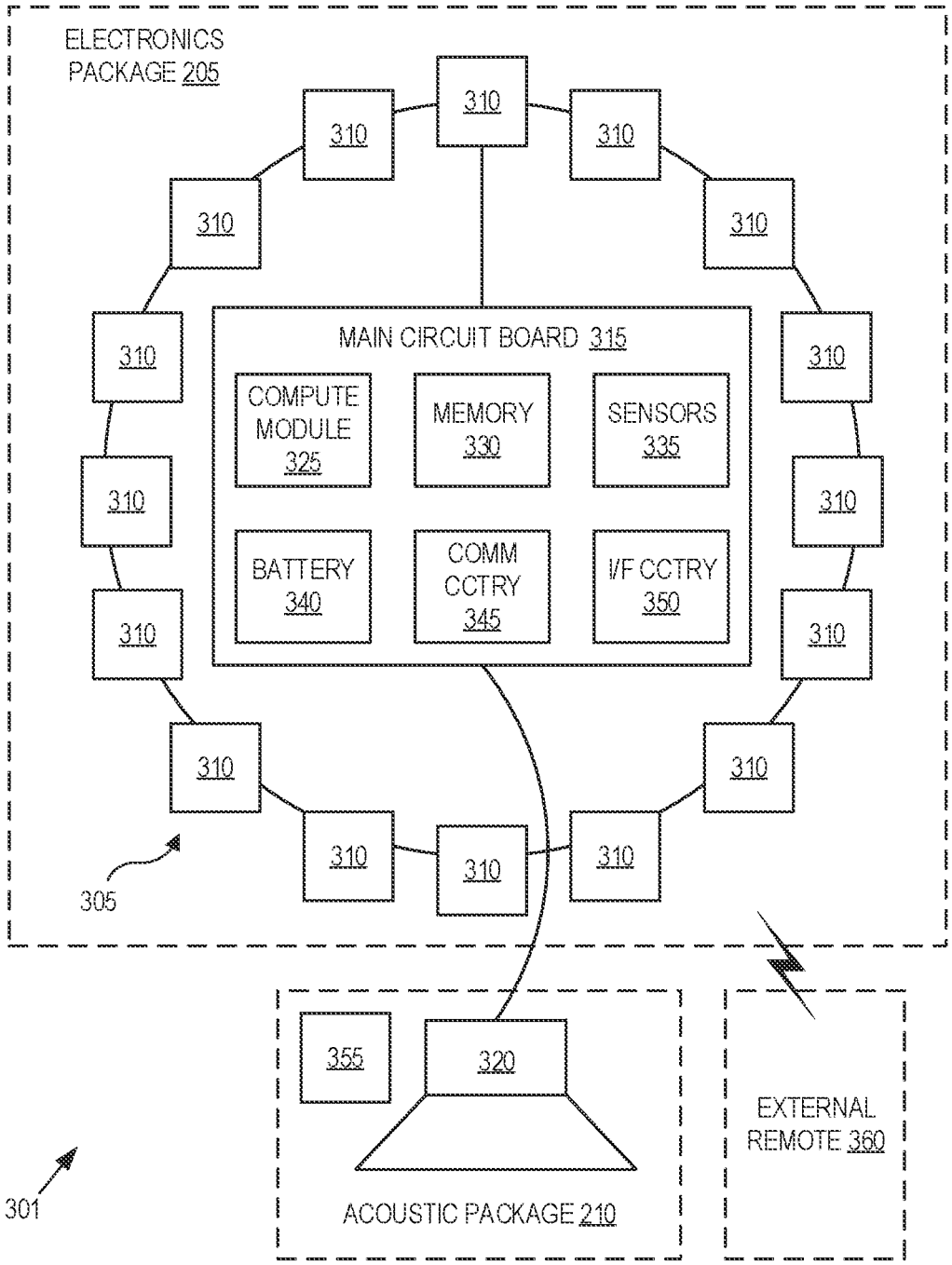
FIG. 3 is a block diagram illustrating select functional components of the ear-mountable listening device, in accordance with an embodiment of the disclosure.

FIG. 3 is a block diagram illustrating select functional components 300 of ear-mountable listening device 301, in accordance with an embodiment of the disclosure. Ear-mountable listening device 301 is one possible implementation of ear-mountable listening device 101 illustrated in FIGS. 1A-IC and ear-mountable listening device 201 illustrated in FIG. 2. The illustrated embodiment of components 300 in FIG. 3 includes an adaptive phased array 305 of microphones 310 and a main circuit board 315 disposed within electronics package 205 while speakers 320 are disposed within acoustic package 210. Main circuit board 315 includes various electronics disposed thereon including a compute module 325, memory 330, sensors 335, battery 340, communication circuitry 345, and interface circuitry 350. The illustrated embodiment also includes an internal microphone 355 disposed within acoustic package 210. An external remote 360 (e.g., handheld device, smart ring, etc.) may be wirelessly coupled to ear-mountable listening device 101 (or binaural listening system 100) via communication circuitry 345. Although not illustrated, acoustic package 210 may also include some electronics for digital signal processing (DSP), such as a printed circuit board (PCB) containing a signal decoder and DSP processor for digital-to-analog (DAC) conversion and EQ processing, a bi-amped crossover, and various auto-noise cancellation and occlusion processing logic.

In one embodiment, microphones 310 are arranged in a ring pattern (e.g., circular array, elliptical array, etc.) around a perimeter of main circuit board 315. Main circuit board 315 itself may have a flat disk shape, and in some embodiments, is an annular disk with a central hole. There are a number of advantages to mounting multiple microphones 310 about a flat disk on the side of the user's head for an ear-mountable listening device. However, one limitation of such an arrangement is that the flat disk restricts what can be done with the space occupied by the disk. This becomes a significant limitation if it is necessary or desirable to orientate a loudspeaker, such as speakers 320 (or speakers 212), on axis with the auditory canal as this may push the flat disk (and thus electronics package 205) quite proud of the ears. In the case of a binaural listening system, protrusion of electronics package 205 significantly out past the pinna plane may even distort the natural time of arrival of the sounds to each ear and further distort spatial perception and the user's HRTF potentially beyond a calibratable correction. Fashioning the disk as an annulus (or donut) enables protrusion of the driver of speaker 320 (or speakers 212) through main circuit board 315 and thus a more direct orientation/alignment of speaker 320 with the entrance of the auditory canal.

Microphones 310 may each be disposed on their own individual microphone substrates. The microphone port of each microphone 310 may be spaced in substantially equal angular increments about central axial axis 225. In FIG. 3, sixteen microphones 310 are equally spaced; however, in other embodiments, more or less microphones may be distributed (evenly or unevenly) in the ring pattern about central axial axis 225.

Compute module 325 may include a programmable microcontroller that executes software/firmware logic stored in memory 330, hardware logic (e.g., application specific integrated circuit, field programmable gate array, etc.), or a combination of both. Although FIG. 3 illustrates compute module 325 as a single centralized resource, it should be appreciated that compute module 325 may represent multiple compute resources disposed across multiple hardware elements on main circuit board 315 and which interoperate to collectively orchestrate the operation of the other functional components. For example, compute module 325 may execute logic to turn ear-mountable listening device 101 on/off, monitor a charge status of battery 340 (e.g., lithium ion battery, etc.), pair and unpair wireless connections, switch between multiple audio sources, execute play, pause, skip, and volume adjustment commands received from interface circuitry 350, commence multi-way communication sessions (e.g., initiate a phone call via a wirelessly coupled phone), control volume of the real-world environment passed to speaker 320 (e.g., modulate noise cancellation and perceptual transparency), enable/disable speech enhancement modes, enable/disable smart volume modes (e.g., adjusting max volume threshold and noise floor), or otherwise. In some embodiments, compute module 325 may operably configure (e.g., variably power) a plurality of electroacoustic transducers included in the acoustic package 210 to emit audio in response to an audio signal (e.g., from one or more audio sources).

Sensors 335 may include a variety of sensors such as an inertial measurement unit (IMU) including one or more of a three axis accelerometer, a magnetometer (e.g., compass), or a gyroscope. Communication interface 345 may include one or more wireless transceivers including near-field magnetic induction (NFMI) communication circuitry and antenna, ultra-wideband (UWB) transceivers, a WiFi transceiver, a radio frequency identification (RFID) backscatter tag, a Bluetooth antenna, or otherwise. Interface circuitry 350 may include a capacitive touch sensor disposed across the distal surface of electronics package 205 to support touch commands and gestures on the outer portion of the puck-like surface, as well as a rotary user interface (e.g., rotary encoder) to support rotary commands by rotating the puck-like surface of electronics package 205. A mechanical push button interface operated by pushing on electronics package 205 may also be implemented.

Figure 4A:
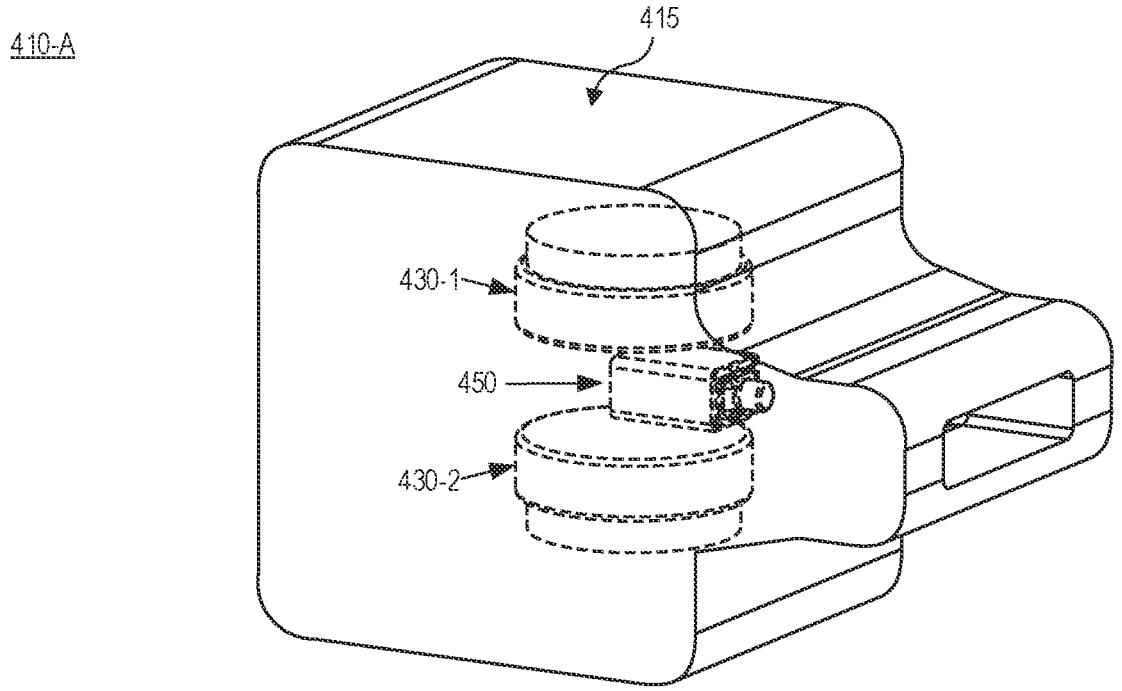
FIGS. 4A-4C illustrate various views of an acoustic package included in the ear-mountable listening device, in accordance with an embodiment of the disclosure.
Figure 4B:
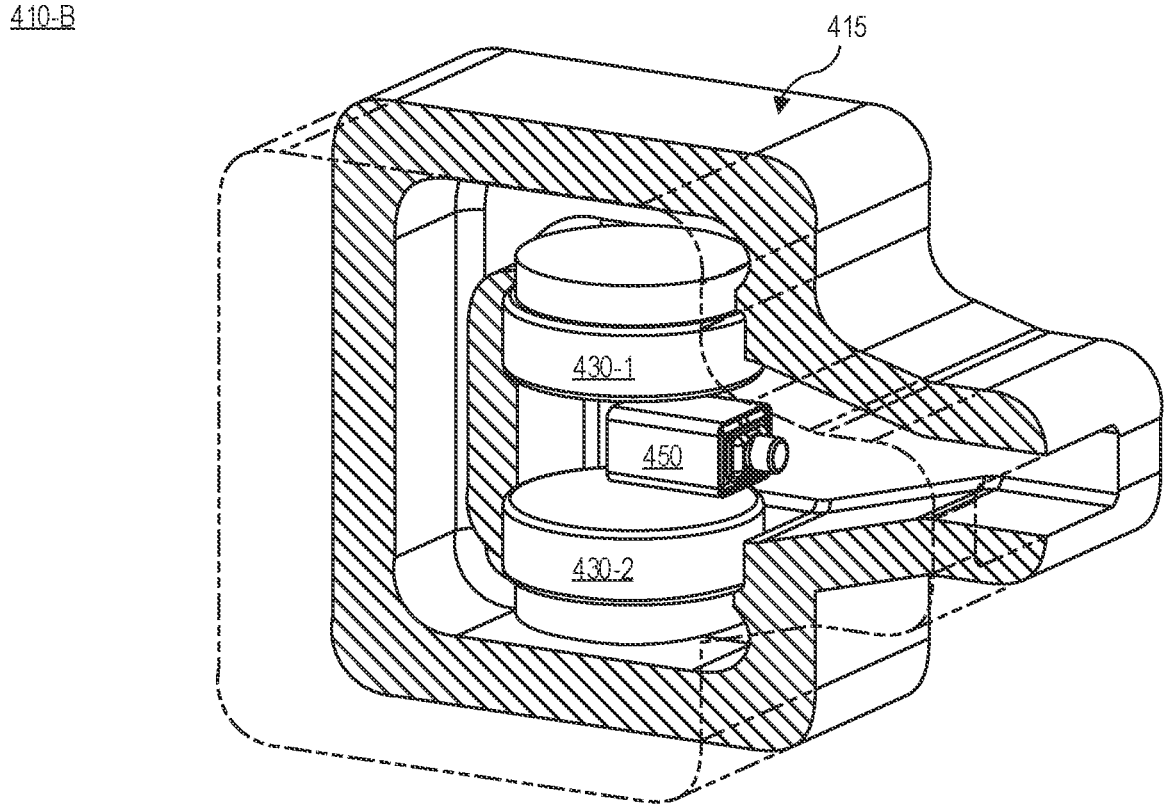
Figure 4C:
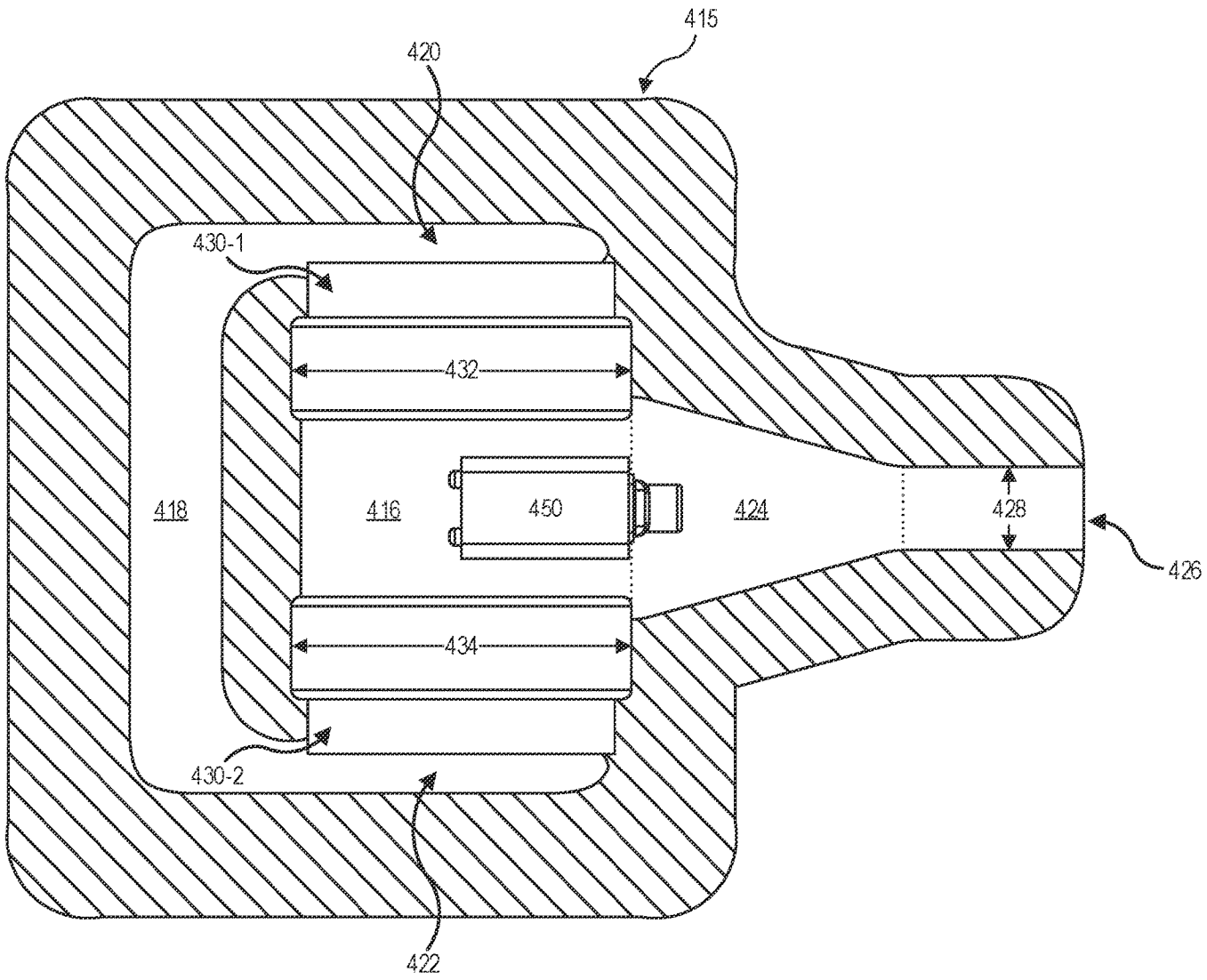

FIGS. 4A-4C illustrate various views of an acoustic package 410 included in the ear-mountable listening device, in accordance with an embodiment of the disclosure. Acoustic package 410 is one possible implementation of acoustic package 210 illustrated in FIG. 2 and FIG. 3. In other words, acoustic package 410 may be implemented in the various embodiments of ear-mountable listening devices described within the disclosure. Referring back to FIGS. 4A-4C, acoustic package 410 includes a manifold 415, a plurality of electroacoustic transducers 430 (e.g., first transducer 430-1 and second transducers 430-2), and an optional balanced armature 450. As illustrated, the manifold 415 is shaped or otherwise structured to hold the plurality of electroacoustic transducers 430 and the optional balanced armature 450 in specific positions relative to one another and forms, at least in part, an acoustic package for an ear-mountable listening device. In some embodiments, the plurality of electroacoustic transducers 430 and balanced armature 450 may operate in tandem to provide an expanded frequency response of the ear-mountable listening device with the balanced armature 450 responsible for reproduction of high frequencies (e.g., corresponding to a tweeter) and the plurality of electroacoustic transducers responsible for reproduction of low to mid-range frequencies (e.g., corresponding to a woofer). In other embodiments, the balanced armature 450 may be omitted such that the plurality of electroacoustic transducers is responsible for the reproduction of as much of the audio frequency range as possible (e.g., corresponding to a full-range speaker or driver).

As illustrated in FIG. 4C, the manifold 415 may be a monolithic or multi-piece component (e.g., formed by a plastic such as acrylonitrile butadiene styrene or any other suitable material) that is coupled to the first transducer 430-1, the second transducer 430-2, and the balanced armature 450. More specifically, the manifold 415 is shaped to position the first transducer 430-1 and the second transducer 430-2 to face one another and form a front cavity 416 disposed between the first transducer 430-1 and the second transducer 430-2. The manifold is further shaped to form a back cavity 418 that is acoustically isolated from the front cavity 417.

Described herein, the term "cavity" represents one or more regions defined by the structure of the manifold 415 that are filled with air or other gaseous material rather than a solid material. For example, when the first transducer 430-1 is driven, a diaphragm within the transducer moves to push air and generate pressure waves on either side of the transducer. Front waves are generated proximate to the side of the transducer proximate to the front cavity 416 while back waves are generated proximate to the side of the transducer proximate to the back cavity 418. If the front waves and back waves recombine while being in phase, then the front and back waves may cancel each other out or otherwise attenuate the pressure waves, which results in no or reduced audio emission. As mentioned above, the manifold is structured to acoustically isolate the front cavity 416 from the back cavity 418. The term "acoustically isolated" means that manifold is structured (e.g., by virtue of the shape, material properties, and relative positioning of the first transducer 430-1 and the second transducer 430-2) to prevent or otherwise mitigate the front waves and back waves generated by the plurality of transducers 430 from recombining and canceling one another out (e.g., due to having a common phase).

As illustrated in FIG. 4C, the manifold is coupled to, or otherwise forms, an output port 426 to direct audio (e.g., front waves) from the front cavity 416 into an ear (e.g., ear canal) when the plurality of electroacoustic transducers 430 emit the audio. In some embodiments, the first transducer 430-1 faces the second transducer 430-2 such that a first longitudinal plane (e.g., a plane going in and out of the page of FIG. 4C that is substantially parallel with the direction 432) of the first transducer 430-1 and a second longitudinal plane (e.g., a plane going in and out of the page of FIG. 4C that is substantially parallel with the direction 434) are both perpendicular to a planar opening (e.g., a plane going in and out of the page of FIG. 4C that is substantially parallel to direction 428) of the output port 426. In other embodiments, the first transducer 430-1 and the second transducer 430-2 may face one another, but not necessarily be parallel to one another. For example, planar sides of the first transducer 430-1 and the second transducer 430-2 may deviate from parallel by less than 5°, less than 10°, less than 15°, less than 30°, or otherwise. In the same or other embodiments, the output port 426 forms a cavity 424 that tapers from the front cavity 416 towards the opening of the output port 426. As illustrated, the cavity has an initial width approximately equal to the width of the front cavity 416 that linearly decreases to the width of the opening of the output port 426. In other embodiments, the taper may be non-linear. In some embodiments, the cavity 424 may not taper at all and instead have a continuous width substantially equal to the width of the front cavity 416.

In the illustrated embodiment of FIG. 4C, the first transducer 430-1 is disposed between a first portion 420 of the back cavity 418 and the front cavity 416. The second transducer 430-2 is disposed between a second portion 422 of the back cavity 418 and the front cavity 416. In other words, the back cavity 418 is a singular cavity with a two-prong shape. In other embodiments, the back cavity 418 may have a multi-cavity shape such that the first portion 420 and the second portion 422 are isolated from one another. In one embodiment, a first volume of the front cavity 416 is less than a second volume of the back cavity 418. Advantageously, by increasing the volume of the back cavity 418, the frequency response of the acoustic package may be enhanced. In the illustrated embodiment, the balanced armature 450 is disposed, at least partially, within the front cavity 416 between the first transducer 430-1 and the second transducer 430-2. In other embodiments, the balanced armature 450 may be omitted or disposed elsewhere within the acoustic package 410.

Figure 5A:
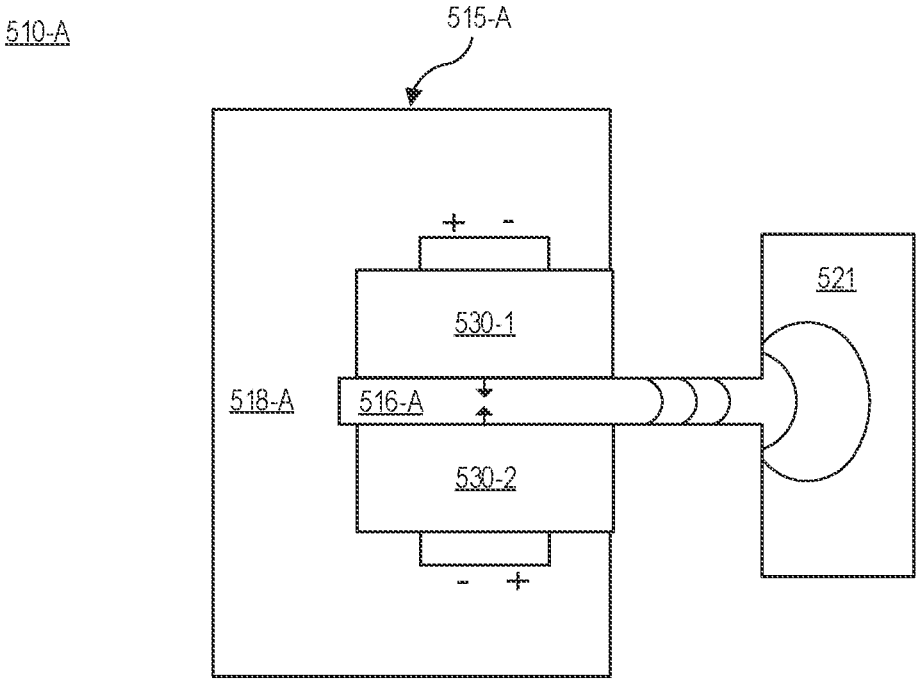
FIG. 5A illustrates an example schematic of an acoustic package with multiple transducers when the ear-mountable listening device is inserted in an ear, in accordance with an embodiment of the disclosure.
Figure 5B:
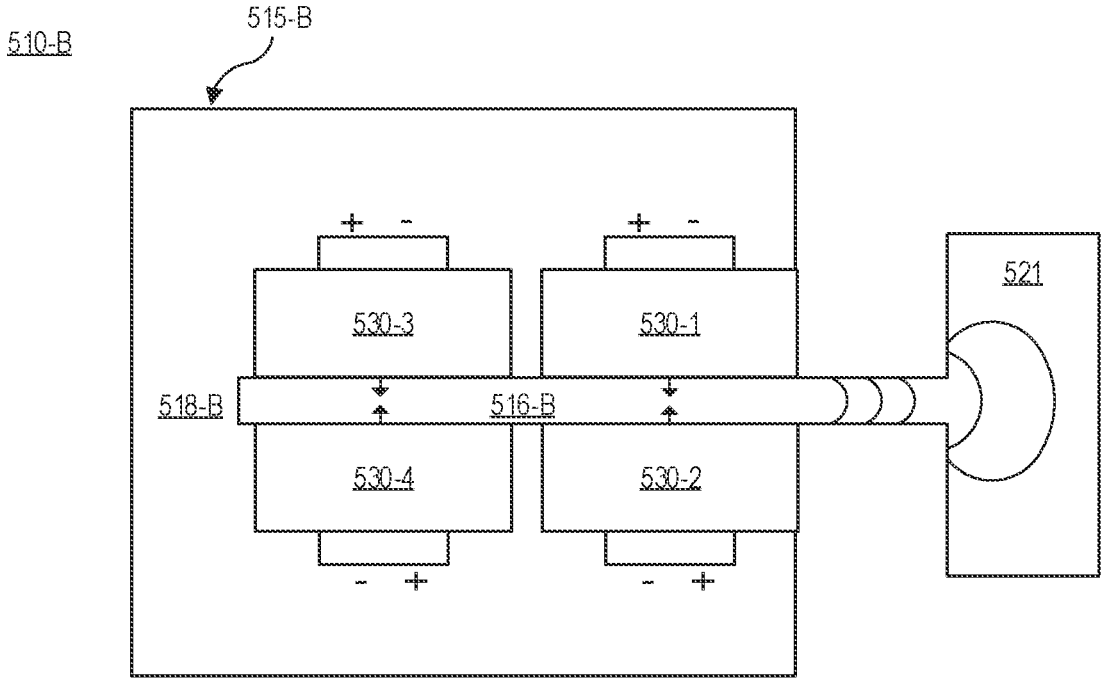
FIG. 5B illustrates an example schematic of an acoustic package with multiple pairs of transducers, in accordance with an embodiment of the disclosure.

FIG. 5A and FIG. 5B illustrate example schematics of an acoustic package 510 with multiple transducers when the ear-mountable listening device is inserted in an ear, in accordance with an embodiment of the disclosure. Acoustic package 510 is one possible implementation of acoustic package 210 illustrated in FIG. 2 and FIG. 3 and acoustic package 410 illustrated in FIGS. 4A-4C. Acoustic package 510 includes like-labeled elements including a manifold 515, which is shaped to form a front cavity 516 and a back cavity 518, and a plurality of electroacoustic transducers 530. It is appreciated that terminals of each of the plurality of electroacoustic transducers 530 in the illustrated embodiments are shown with a corresponding positive terminal labeled "+" and a corresponding negative terminal labeled "−." The terminals of the plurality of electroacoustic transducers may be electrically coupled to a power source (e.g., battery 340 illustrated in FIG. 3) via control circuitry (e.g., compute module 325 of main circuit board 315 illustrated in FIG. 3). In other words, the main circuit 325 board may drive the plurality of electroacoustic transducers 530 to emit audio in response to an audio signal.

Referring back to FIG. 5A, when a positive bias is applied between the terminals of the first transducer 530-1 and the second transducer 530-2, their diaphragms move in the directions illustrated by the arrows (e.g., towards the front cavity 516-A), which creates a positive pressure within the front cavity 516-A that is directed towards an ear canal volume 521. At the same time that the positive pressure is generated, a negative pressure within the back cavity 518-A is also generated, which is acoustically isolated from the positive pressure in the front cavity 516-A to generate sound. Similarly, when the polarity is reversed (e.g., negative bias between the terminals), a negative pressure is created within the front cavity 516-A and a positive pressure is created within the back cavity 518-A.

As shown in FIG. 5B, the acoustic package 510 is not limited to just two transducers. In the illustrated embodiment, manifold 515-B is structured to hold at least four electroacoustic transducers, including first transducers 530-1, second transducer 530-2, third transducer 530-3, and fourth transducer 530-4. More specifically, the front cavity of the manifold 516-B extends laterally to acoustically couple the first transducer 530-1, the second transducer 530-2, the third transducer 530-3, and the fourth transducer 530-4. In some embodiments, the first transducer 530-1 and the second transducer 530-2 are positioned by the manifold 515-B to face one another as a first pair of transducers and the third transducer 530-3 and the fourth transducer 530-4 are positioned by the manifold 515-B to face one another as a second pair of transducers. It is appreciated that in some embodiments the plurality of electroacoustic transducers 530 may include 2N transducers. In some embodiments, "N" may be any natural number that is greater than or equal to two. In some embodiments, individual transducers may be aligned along a common plane. For example, the first transducer 530-1 and the third transducer 530-3 are both coupled to the front cavity 516-B along a common side of the manifold 515-B and thus are positioned along a longitudinal plane that bisects both the first transducer 530-1 and the third transducer 530-3.

In various embodiments, the electroacoustic transducers 530 may be coupled together in series, parallel, or series-parallel. In series wiring, the positive terminal of an amplifier (e.g., main circuit board 315 illustrated in FIG. 3), may be electrically connected to the positive terminal of a first transducer (e.g., first transducer 530-1) and the negative terminal of that first transducer may be electrically connected to the positive terminal of a second transducer (e.g., second transducer 530-2). This process may continue until the positive terminal of the last transducer (e.g., fourth transducer 530-4 in embodiments with only four transducers), is electrically connected to the negative terminal of the amplifier. In embodiments with parallel wiring, the positive terminals of the plurality of electroacoustic transducers 530 are electrically coupled together and to the positive terminal of the amplifier, while the negative terminals of the plurality of electroacoustic transducers 530 are electrically coupled together and to the negative terminal of the amplifier. If four or more transducers are included in the plurality of electroacoustic transducers 530, then series-parallel wiring may be utilized in which adjacent transducers (e.g., first transducer 530-1 and third transducer 530-3) are wired in series as pairs. The pairs are then connected in parallel with the amplifier.

Figure 6A:
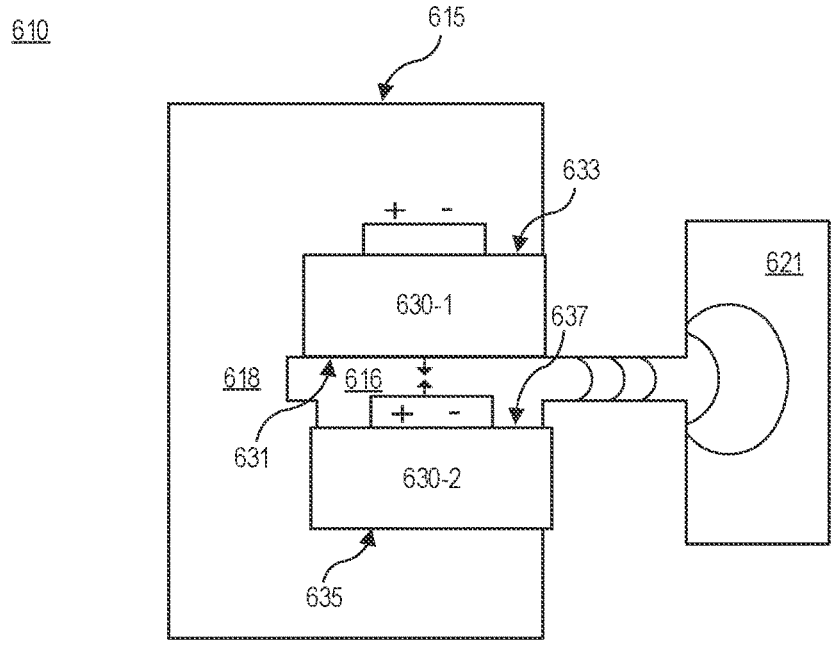
FIG. 6A illustrates an example schematic of an acoustic package with a second transducer having a reversed orientation relative to a first transducer, in accordance with an embodiment of the disclosure.

FIG. 6A illustrates an example schematic of an acoustic package 610 with a second transducer 630-2 having a reversed orientation relative to a first transducer 630-1, in accordance with an embodiment of the disclosure. Acoustic package 610 is one possible implementation of acoustic package 210 illustrated in FIG. 2 and FIG. 3, acoustic package 410 illustrated in FIGS. 4A-4C, and acoustic package 510 illustrated in FIGS. 5A-5B. Acoustic package 610 includes like-labeled elements including a manifold 615, which is shaped to form a front cavity 616 and a back cavity 618, and a plurality of electroacoustic transducers 630.

Acoustic package 610 is similar to acoustic package 510 of FIG. 5A. One difference of acoustic package 610 illustrated in FIG. 6A is that the second transducer 630-2 has a reversed orientation relative to the first transducer 630-1 such that a back side 637 of the second transducer is disposed between a front side 635 of the second transducer 630-2 and a front side 631 of the first transducer 630-1. Described herein, the term "front side" refers to a side of the transducer that generates a positive pressure wave when then transducer is positively bias and has a standard polarity coupling with an amplifier (e.g., the positive terminal of the transducer is coupled to the positive terminal of the amplifier and the negative terminal of the transducer coupled to the negative terminal of the amplifier). The term "back side" refers to the side of the transducer opposite the front side. For example, the back side 633 of the first transducer 630-1 is opposite of the front side 631. In the illustrated embodiment, the transducer with the reversed orientation (e.g., the transducer with the back side closer to the front cavity 616 relative to the corresponding front side) is coupled to a power source via a reversed polarity coupling. More specifically, the reversed polarity coupling causes the diaphragm of the reversed orientation transducer to move in an opposite direction of the transducer without the reversed orientation. For example, the negative terminal of the second transducer 630-2 may be electrically coupled to the positive terminal of the amplifier or power source and the positive terminal of the second transducer 630-2 may be electrically coupled to the negative terminal of the amplifier or power source. Consequently, when a bias is applied, the plurality of transducers 630 move in opposite directions as illustrated to generate corresponding front and back waves. It is appreciated that in other embodiments the first transducer 630-1 may have a reversed orientation and similarly have a reversed polarity coupling to the power source relative to relative to the second transducer 630-2.

Figure 6B:
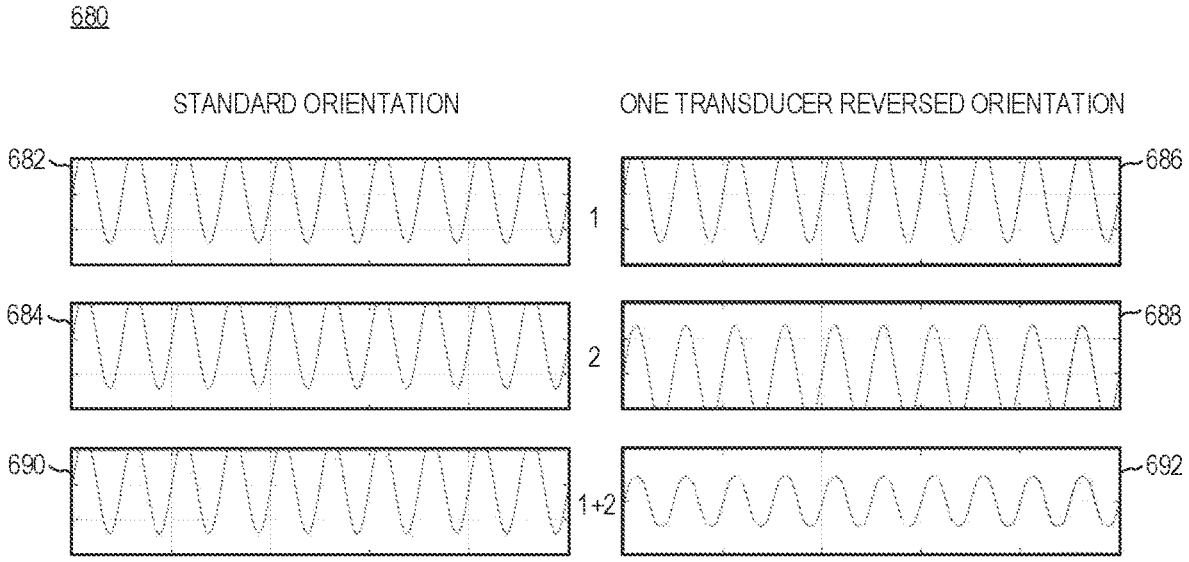
FIG. 6B illustrates an example acoustic pressure chart of paired transducers, in accordance with an embodiment of the disclosure.

FIG. 6B illustrates an example acoustic pressure chart 680 of paired transducers, in accordance with an embodiment of the disclosure. More specifically, chart 680 compares waveforms 682 and 684, which are representative of the acoustic pressure generated by a first set of transducers that both have a standard orientation (e.g., for the plurality of electroacoustic transducers 530 illustrated in FIG. 5A), to waveforms 686 and 688, which are representative of a second set of transducers that have one standard orientation and one reversed orientation (e.g., for the plurality of electroacoustic transducers 630 illustrated in FIG. 6A). In other words, waveforms 682, 684, and 686 are each representative of the acoustic pressure output by a transducer with a standard orientation while waveform 688 is representative of the acoustic pressure output by a transducer with a reversed orientation. The top row illustrates waveforms representative of the acoustic pressure output by a first transducer (e.g., transducer 530-1 of FIG. 5A in the first column and transducer 630-1 in the second column). The middle row illustrates the waveforms representative of the acoustic pressure for a second transducer (e.g., transducer 530-2 of FIG. 5A in the first column or transducer 630-2 with the reversed orientation in the second column). The bottom row illustrates the combination of the waveforms (e.g., summation) for the paired transducers of a given column (e.g., waveform 690 is representative of the summation of waveforms 682 and 684 while waveform 692 is representative of the summation of waveforms 686 and 688). As illustrated when comparing the bottom row waveforms 690 and 692, the peaks and valleys of the pair of transducers configured with one transducer in reversed orientation (e.g., waveform 692) are broader relative to the peaks and valleys of the pair of transducers with the standard orientation (e.g., waveform 690). Advantageously, by flipping one of the transducers and wiring the flipped transducer to have reverse polarity wiring, any asymmetries in the nonlinear characteristic of the transducers are canceled and even order distortions may also be greatly reduced.

Figure 7A:
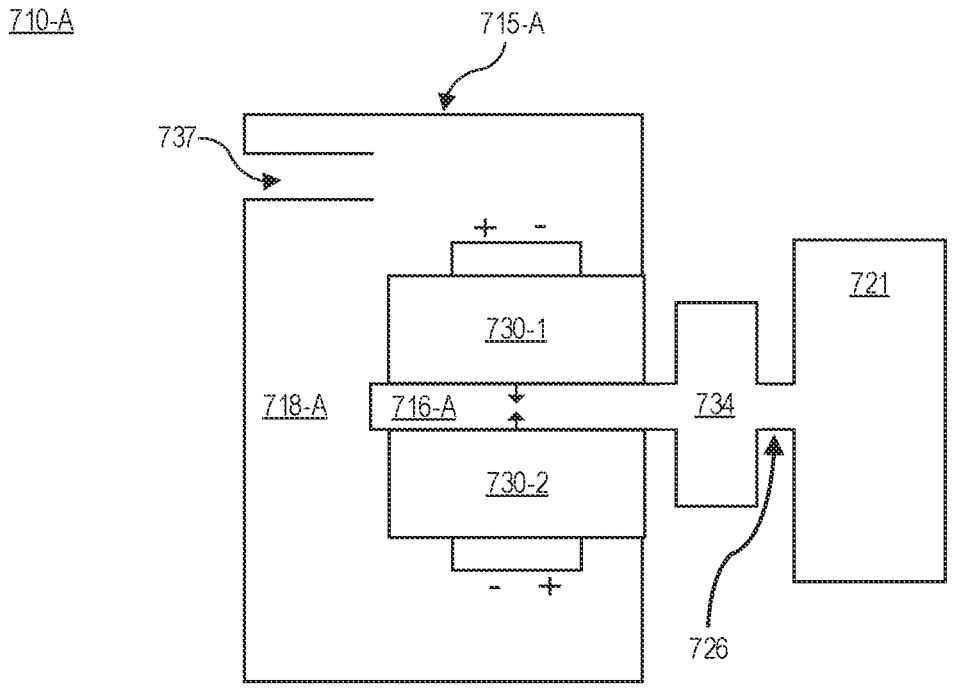
FIG. 7A illustrates an example schematic of an acoustic package with a vent to an area outside of an ear, in accordance with an embodiment of the disclosure.
Figure 7B:
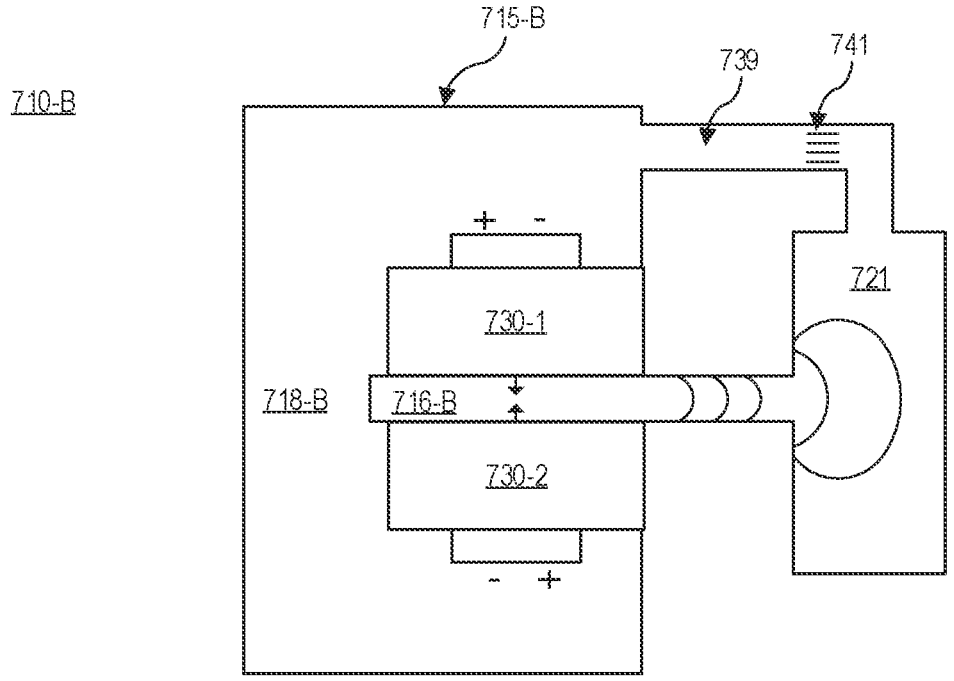
FIG. 7B illustrates an example schematic of an acoustic package with an interlinking vent, in accordance with an embodiment of the disclosure.

FIG. 7A and FIG. 7B illustrate an example schematic of an acoustic package 710 with a vent 737 to an area outside of an ear or an interlinking vent 739, in accordance with an embodiment of the disclosure. Acoustic package 710 includes features that may be implemented in acoustic package 210 illustrated in FIG. 2 and FIG. 3, acoustic package 410 illustrated in FIGS. 4A-4C, acoustic package 510 illustrated in FIGS. 5A-5B, and acoustic package 610 illustrated in FIG. 6A.

Acoustic package 710 is similar to acoustic package 510 of FIG. 5A. One difference of acoustic package 710 illustrated in FIG. 7A is that manifold 715-A forms a third cavity 734 and/or a vent 737. As illustrated, the third cavity 734 is disposed between output port 726 and front cavity 716-A. The third cavity provides an additional volume that may be tuned to adjust a frequency response of the acoustic package to include a peak at approximately (e.g., ±5%, 10%, 15%, or any other pre-determined threshold percentage) 3 kHz. In doing so, the ear-mountable listening device that includes the acoustic package 710 may recreate a resonance that naturally occurs in the ear canal 721. Alternatively, or additionally, the acoustic package includes the vent 737 formed, at least in part, in the manifold 715-A to couple the back cavity 718-A with an area outside of the ear. Advantageously, vent 737 may allow the diaphragms of the first transducer 730-1 and the second transducer 730-2 to move more freely and thus increase the bass response of the system.

Referring to FIG. 7B, acoustic package 710-B includes many of the same components of the acoustic package 710-A. One difference is acoustic package 710-B includes an interlinking vent 739 that couples the back cavity 718-B with the ear canal 721. More specifically, the interlinking vent 739 is structured to phase invert or phase shift the back waves from the back cavity 718-B and direct the inverted waves to recombine with the front waves from the front cavity 716-B within the ear canal 721. Advantageously, this may be utilized to reinforce a range of frequencies reproduced by the device. Additionally, or alternatively, manifold 715-B may also include one or more acoustic resistors (e.g., a mesh with a size and density configured to adjust acoustic resistance as targeted) within any portion of the acoustic package 710. For example, acoustic resistor 741 is located within the interlinking vent 739. In the same or other embodiments, an acoustic resistor may be located within the front cavity 716, the back cavity 718, the output port 726, the vent 739, or the like.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An ear-mountable listening device, comprising:

a plurality of electroacoustic transducers to emit audio in response to an audio signal, wherein the plurality of electroacoustic transducers includes a first transducer and a second transducer;

a manifold coupled to the plurality of electroacoustic transducers, wherein the manifold is shaped to position the first transducer and the second transducer to face one another and form a front cavity disposed between the first transducer and the second transducer, wherein the manifold further forms a third cavity disposed between the output port and the front cavity, and the third cavity is shaped to adjust a frequency response of the ear-mountable listening device; and an output port coupled to the manifold to direct the audio from the front cavity into an ear when the plurality of electroacoustic transducers emits the audio.

2. The ear-mountable listening device of claim 1, wherein the manifold is further shaped to form a back cavity acoustically isolated from the front cavity, wherein the first transducer is disposed between a first portion of the back cavity and the front cavity, and wherein the second transducer is disposed between a second portion of the back cavity and the front cavity.

3. The ear-mountable listening device of claim 1, wherein the output port forms a planar opening substantially perpendicular to a first longitudinal plane of the first transducer and a second longitudinal plane of the second transducer, and wherein the first longitudinal plane is substantially parallel to the second longitudinal plane.

4. The ear-mountable listening device of claim 1, further comprising a balanced armature disposed, at least partially, within the front cavity between the first transducer and the second transducer.

5. The ear-mountable listening device of claim 1, wherein the second transducer has a reversed orientation relative to the first transducer such that a back side of the second transducer is disposed between a front side of the second transducer and a front side of the first transducer.

6. The ear-mountable listening device of claim 5, further comprising control circuitry to couple the first transducer and the second transducer to a power source, and wherein the second transducer is a reversed polarity coupling to the power source relative to the first transducer.

7. The ear-mountable listening device of claim 1, wherein the plurality of electroacoustic transducers further includes a third transducer and a fourth transducer positioned within the ear-mountable listening device to face one another.

8. The ear-mountable listening device of claim 7, further comprising control circuitry to couple the plurality of electroacoustic transducers to a power source.

9. The ear-mountable listening device of claim 8, wherein the plurality of electroacoustic transducers is coupled together in series, parallel, or series-parallel.

10. The ear-mountable listening device of claim 7, wherein the front cavity of the manifold extends to acoustically couple the third transducer and the fourth transducer to the first transducer and the second transducer.

11. The ear-mountable listening device of claim 1, wherein the plurality of electroacoustic transducers includes 2N transducers, and wherein N is a natural number greater than or equal to two.

12. The ear-mountable listening device of claim 1, further comprising a vent formed, at least in part, in the manifold to couple a back cavity with an area outside of the ear.

13. The ear-mountable listening device of claim 1, wherein the plurality of electroacoustic transducers generate front waves and back waves when emitting the audio, the front waves are directed towards the front cavity and the back waves are directed towards a back cavity, and the ear-mountable listening device further includes an interlinking vent structured to phase invert the back waves and direct the inverted waves to recombine with the front waves.

14. A binaural listening system, comprising:

a first ear-mountable listening device for wearing in a first ear of a user; and a second ear-mountable listening device for wearing in a second ear of the user, wherein the first and second ear-mountable listening devices each include:

a plurality of electroacoustic transducers to emit audio in response to an audio signal, wherein the plurality of electroacoustic transducers includes a first transducer and a second transducer;

a manifold coupled to the plurality of electroacoustic transducers, wherein the manifold is shaped to position the first transducer and the second transducer to face one another and form a front cavity disposed between the first transducer and the second transducer, wherein the manifold further forms a third cavity disposed between the output port and the front cavity, and the third cavity is shaped to adjust a frequency response of at least one of the first and second ear-mountable listening devices; and an output port coupled to the manifold to direct the audio from the front cavity into a corresponding one of the first ear or the second ear.

15. The binaural listening system of claim 14, wherein for at least one of the first ear-mountable listening device or the second ear-mountable listening device the manifold is further shaped to form a back cavity acoustically isolated from the front cavity, wherein the first transducer is disposed between a first portion of the back cavity and the front cavity, and wherein the second transducer is disposed between a second portion of the back cavity and the front cavity.

16. The binaural listening system of claim 14, wherein for at least one of the first ear-mountable listening device or the second ear-mountable listening device the output port forms a planar opening substantially perpendicular to a first longitudinal plane of the first transducer and a second longitudinal plane of the second transducer, and wherein the first longitudinal plane is substantially parallel to the second longitudinal plane.

17. The binaural listening system of claim 14, further comprising a balanced armature disposed, at least partially, within the front cavity between the first transducer and the second transducer for at least one of the first ear-mountable listening device or the second ear-mountable listening device.

18. The binaural listening system of claim 14, wherein for at least one of the first ear-mountable listening device or the second ear-mountable listening device the first transducer has a reversed orientation relative to the second transducer such that a back side of the first transducer is disposed between a front side of the second transducer and a front side of the first transducer.

19. The binaural listening system of claim 18, further comprising control circuitry to couple the first transducer and the second transducer to a power source for at least one of the first ear-mountable listening device or the second ear-mountable listening device, and wherein the second transducer is a reversed polarity coupling to the power source relative to the first transducer.

* * * * *